United States Patent [19]

Evans

[11] 4,227,831

[45] Oct. 14, 1980

[54] SELF-CONTAINED OFFSHORE PLATFORM

[75] Inventor: Darrell L. Evans, Spring, Tex.

[73] Assignee: Raymond International Builders, Inc., Houston, Tex.

[21] Appl. No.: 893,432

[22] Filed: Apr. 4, 1978

[51] Int. Cl.[2] ..... E21B 15/02

[52] U.S. Cl. ..... 405/196; 405/203; 175/7

[58] Field of Search ..... 61/90, 91, 92, 89, 86, 61/87, 88, 93, 94, 101, 102; 175/7, 10; 182/179, 178; 52/632; 405/196, 197, 198, 199, 200, 203, 204, 205, 224, 210, 211

[56] References Cited

U.S. PATENT DOCUMENTS

| | | | |
|---|---|---|---|
| 3,266,208 | 8/1966 | Maggs et al. | 182/179 X |
| 3,380,520 | 4/1968 | Pease | 61/89 |
| 3,528,497 | 9/1970 | Lehman | 175/7 X |
| 3,564,802 | 2/1971 | Dreyfus | 182/179 X |

FOREIGN PATENT DOCUMENTS

| | | | |
|---|---|---|---|
| 1804 | of 1869 | United Kingdom | 61/91 |
| 1051287 | 12/1966 | United Kingdom . | |
| 1399715 | 7/1975 | United Kingdom . | |
| 1446751 | 8/1976 | United Kingdom . | |
| 1463605 | 2/1977 | United Kingdom . | |
| 1499954 | 2/1978 | United Kingdom . | |

*Primary Examiner*—Mervin Stein

*Attorney, Agent, or Firm*—Fitzpatrick, Cella, Harper & Scinto

[57] ABSTRACT

A self-contained jack up type drilling and production platform structure comprising a flotatable barge-like hull with support legs which can be jacked up and down to lower and raise the hull with respect to the surface of the sea. A removeable drilling module rests on top of the hull and extends over an opening therein between two of the support legs. Production equipment is arranged in the hull and communicates with the opening. Moveable conductor supports extend between the legs of the platform and serve to brace the drill string and production conduit conductors.

15 Claims, 22 Drawing Figures

42
36
40
32
44
46
48
30
22
22
22
22
26
10
28
38
4
4
52
52
12
56
50
50
50
14
50
14
56
52
52
18
20
20

42
36
40
14
22
22
14
22
22
26
24
38
26
10
54
54
52
12
5
56
5
52
50
50
14
14
50
7
50
56
7
52
52
18
20
20
54

A
14
50
52
54
56
58
58a
58b
60
62
64
66
68
70
72
74
76
78
80
82
84
86
88
90
92
9
10
11

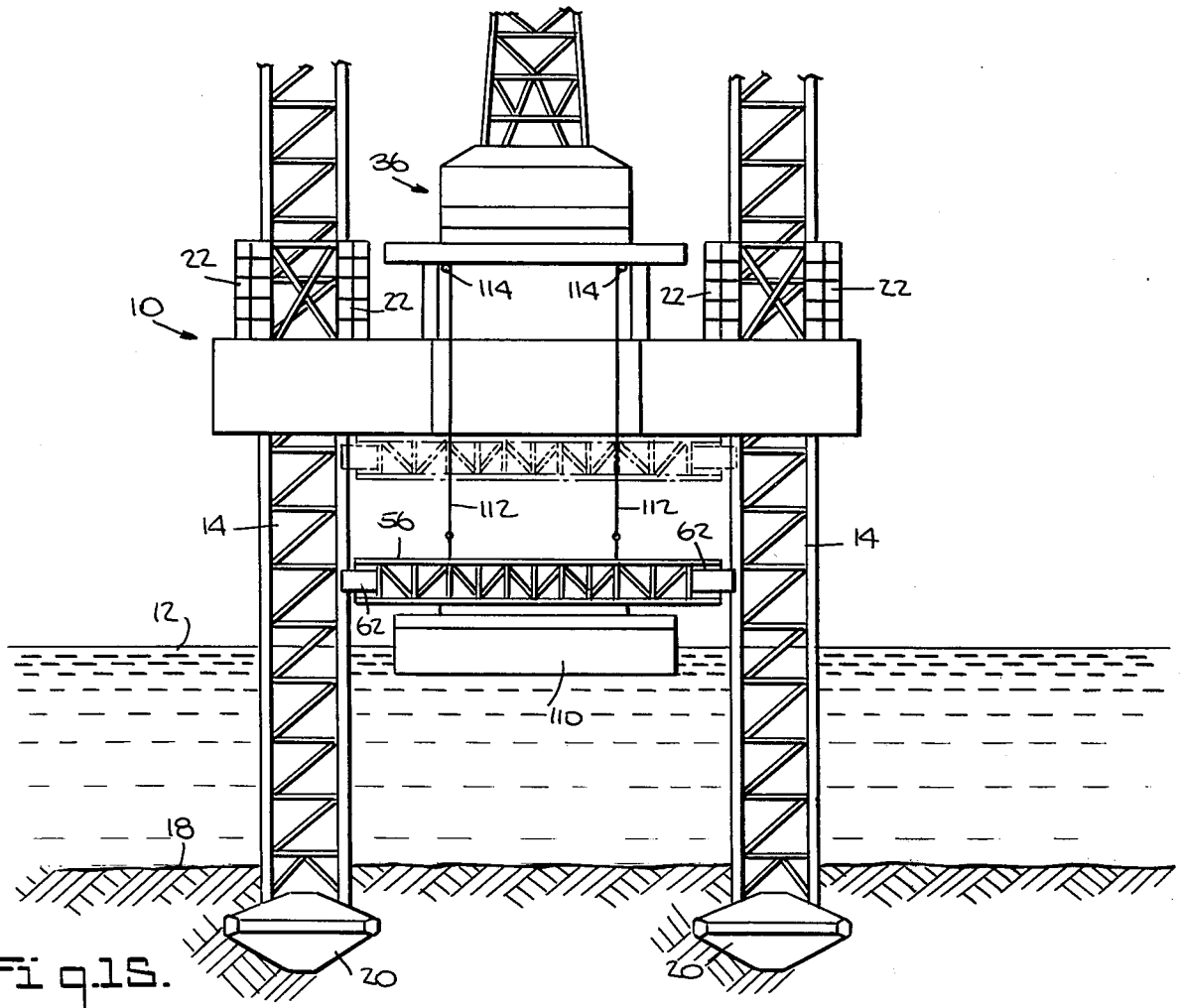
Fig.15.
Fig.16.
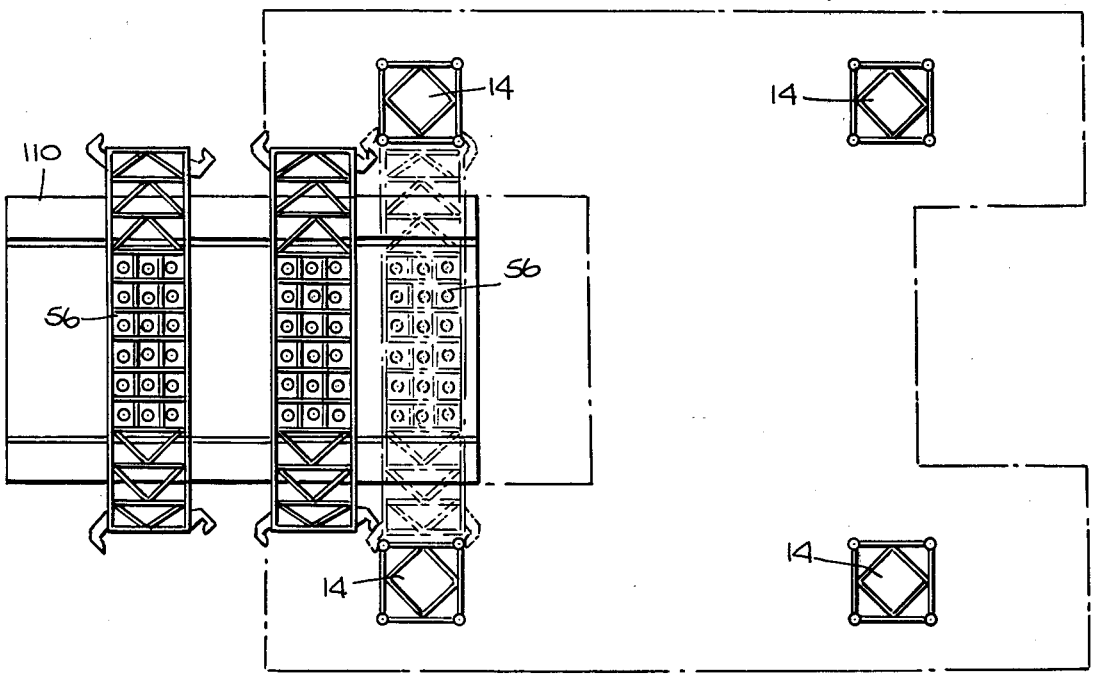

SELF-CONTAINED OFFSHORE PLATFORM

BACKGROUND OF THE INVENTION

1. Field of the Invention

This invention relates to offshore platform structures and more particularly it concerns a novel self-contained and self-installing jack up type drilling and production rig for exploration, drilling and production of oil at offshore locations.

2. Description of the Prior Art

U.S. Pat. Nos. 2,771,747, 2,960,832, 3,001,594, 3,001,595, 3,013,396, 3,593,529, 3,716,993, 3,727,414, 3,874,180 and U.K. Pat. No. 1,446,751 all describe offshore platform structures which can be floated to a desired offshore location and raised up above the sea on self-contained legs which are lowered to the sea floor. These structures are described as being useful for a variety of applications including oil well drilling and production.

The jack up offshore structures shown in U.S. Pat. Nos. 3,001,594, 3,001,595, 3,593,529, 3,727,414, 3,874,180 and 3,999,396 are used both for drilling and for production of oil. These structures are quite complicated and expensive in that they are all made up of one portion which is used for drilling and a separate portion which is used for production. Also, the drilling portion must be moved away before the production portion can be put into operation. In most cases the structure actually involves two separate platforms each mounted on its own set of legs. In U.S. Pat. No. 3,727,414 the same legs are used to support drilling and production platforms but these platforms must be supported on the legs at different times. U.S. Pat. No. 3,999,396 shows a drilling tower mounted over a slot in the hull of an elevated offshore platform structure but no teaching is provided which would enable the same device to be used for simultaneous drilling and production operations.

Another deficiency of the prior art jack-up type offshore platform structures is that none of them are particularly concerned with the provision of a suitable conductor support in those platform structures which are to be used for oil well drilling and production operations. When drilling is to be carried out from an elevated offshore platform, a long, thin drill string, comprised of a series of connected together rods, is lowered down through an elongated tubular conductor which extends from the platform itself down through the sea and into the sea bed. Also, for production operations, one or several relatively thin conduits also extend up through the tubular conductors from the sea bed up to storage and production facilities arranged on the elevated platform. These conductors must be supported laterally, otherwise they will bend or break due to water and wind forces. The proper location or locations for this lateral support, however, will vary according to the water depth, the height of the platform above the water, the bending characteristics of the conductors, and other factors such as wind and sea conditions.

U.S. Pat. No. 3,716,993 shows in FIG. 10 a drill string supported by guides fixed to bottoms of the platform support legs. U.S. Pat. No. 3,727,414 shows a similar arrangement in FIG. 7. U.K. Pat. No. 1,446,751 shows, in FIG. 3, a drill string support extending out from the lower end of a set of upper support legs. None of these patents, however, shown any arrangement for positioning the drill string or conductor supports according to the support requirements of the drill strings or conductor supports themselves.

SUMMARY OF THE INVENTION

The present invention provides an offshore platform structure which is self-contained and self-installing and which, at the same time has novel drill string and conductor support arrangements capable of supporting the drill strings and conductors at optimum locations to protect against undue bending or possible breakage. The arrangements of the present invention, moreover, are economical to construct and convenient to operate.

According to one aspect of the present invention, there is provided an offshore tower structure comprising a barge-like, flotatable hull with a plurality of support legs mounted on the hull to move up and down thereon. Jacking mechanisms are also provided to lift the legs up off the sea bottom when the hull is afloat, and, when the hull is at a desired location and the legs are lowered, to lift the hull up on the legs and out of the sea. The hull is formed with a drilling and production well in the form of an opening therethrough and located between two of the legs to accommodate conductors for drill strings and oil conduits which extend from the hull down to the sea bed. Production facilities, including storage tanks, are located within the hull and these facilities communicate with the oil conduit conductors in the well. A drilling module, including a drilling tower, is mounted on the upper surface of the hull over the drilling and production well to drill down through the conductors. The arrangement of the drilling tower above the drilling and production well together with the containment of production and storage equipment inside the hull permits both drilling and production operations to be carried out simultaneously through different conductors without mutual interference. Thus it is possible to begin production through one conductor while drilling through another conductor.

According to another aspect of the invention there is provided at least one conductor support extending between the two legs located on opposite sides of the hull opening so that the conductor support itself passes under the opening. Guide sleeves are mounted in the conductor supports to surround the conductors extending down from the hull to the sea bed. The conductor support is arranged to be braced laterally by the legs but it is moveable up and down along the legs and it can be locked to the legs at any level. Thus the legs may be positioned on the sea bottom at locations of different water depth and the hull can be raised to various heights above the sea level and yet the conductor support can be independently positioned at the optimum level for proper and effective bracing of the conductors.

In its more specific aspects the present invention provides novel arrangements for mounting the conductor supports onto the offshore platform structure and for positioning the conductor supports at optimum elevations when the offshore platform is installed.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures or methods for carrying out the several purposes of the invention. It is important, therefore, that the claims be regarded as including such equivalent constructions and methods as do not depart from the spirit and scope of the invention.

BRIEF DESCRIPTION OF THE DRAWINGS

A specific embodiment of the invention has been chosen for purposes of illustration and description, and is shown in the accompanying drawings, forming a part of the specification wherein:

FIG. 15 is a view taken along line 15—15 of FIG. 13;

FIG. 16 is a view similar to FIG. 14 but showing the platform portion of the rig in phantom outline and showing a first conductor support in engagement with the legs of the rig;

DETAILED DESCRIPTION OF THE PREFERRED EMBODIMENT

Figure 1:
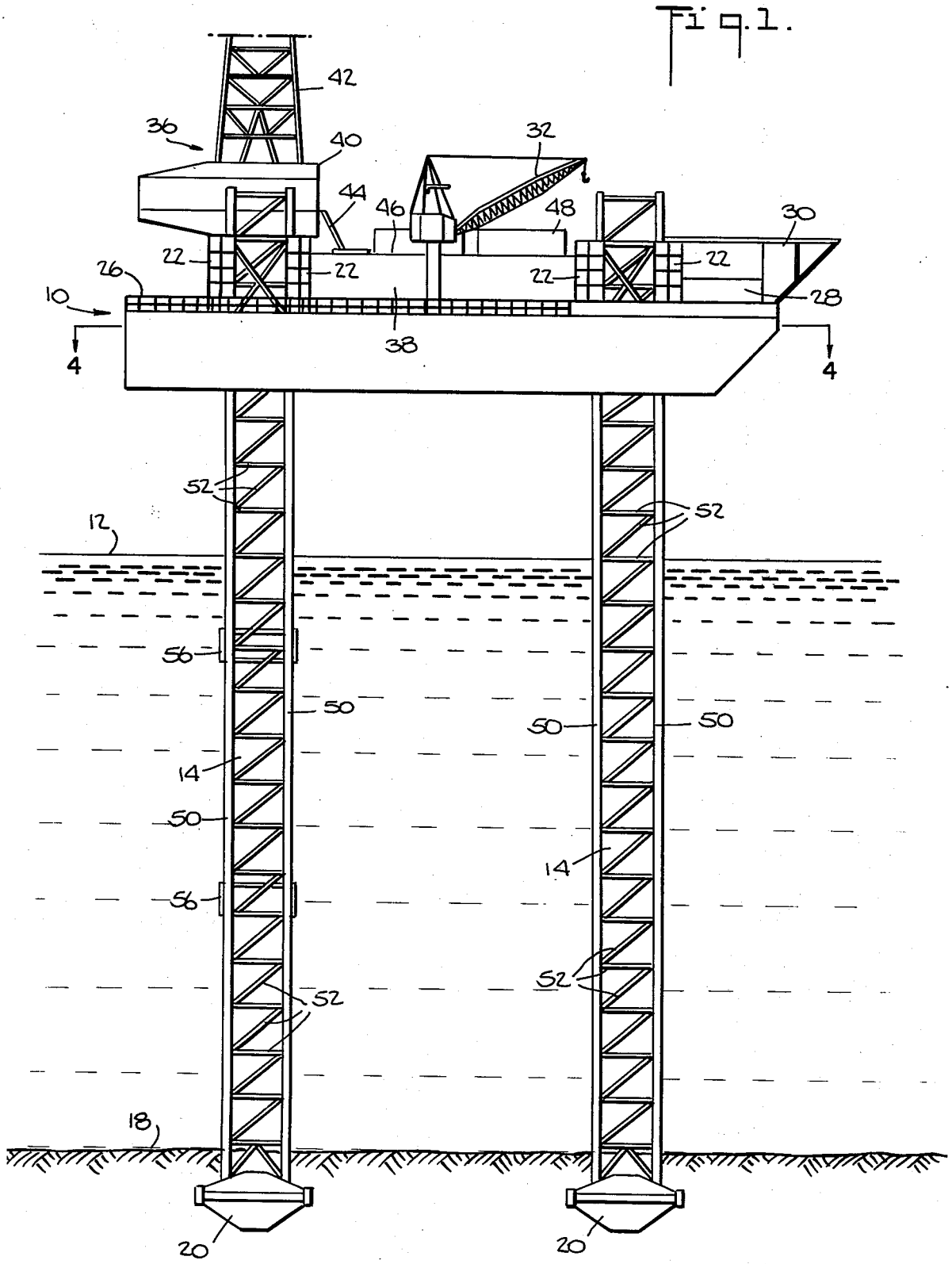
FIG. 1 is a side elevational view of an offshore jack-up type drilling and production rig according to the present invention.
Figure 2:
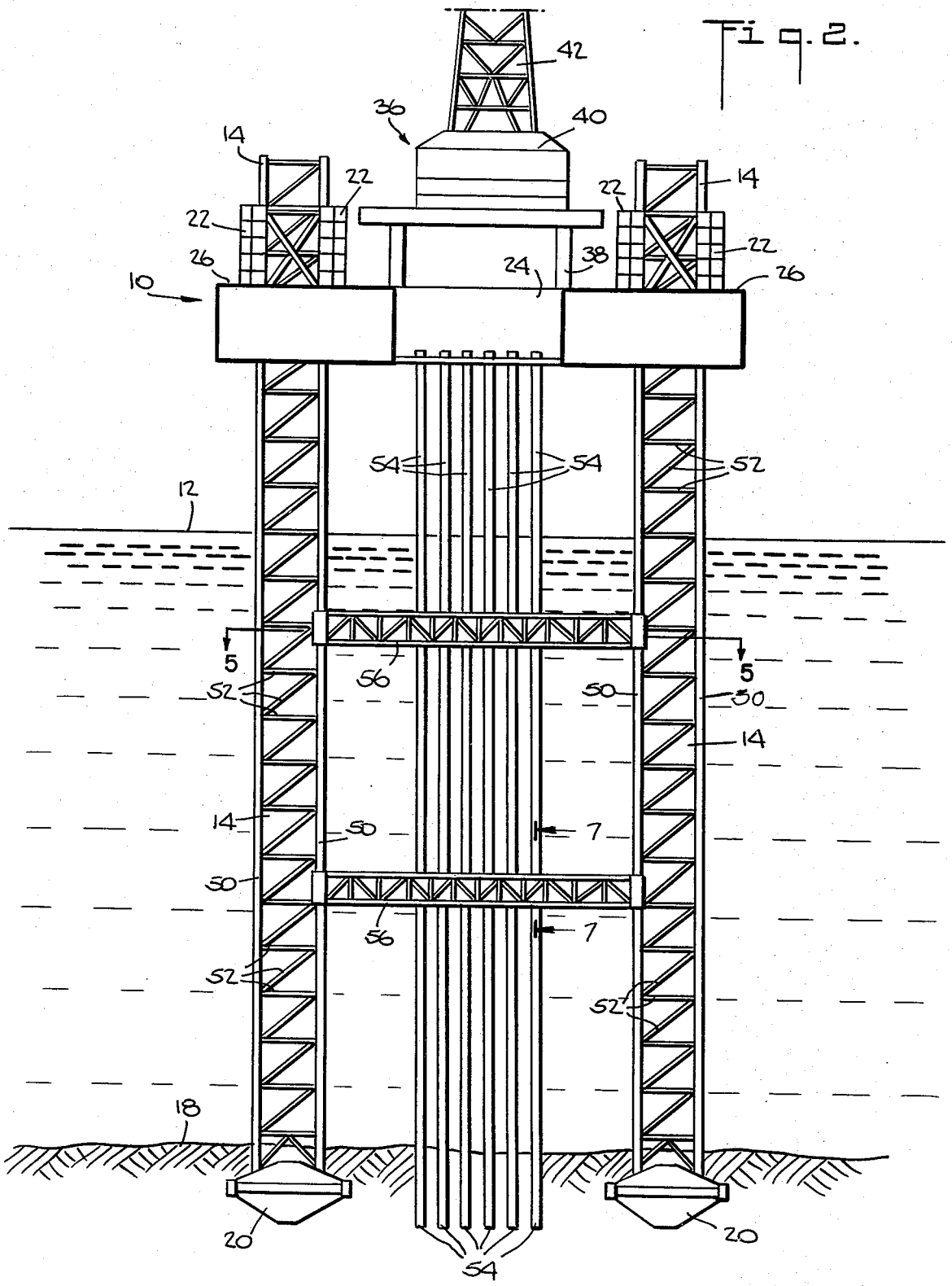
FIG. 2 is an end elevational view of the rig of FIG. 1.
Figure 3:
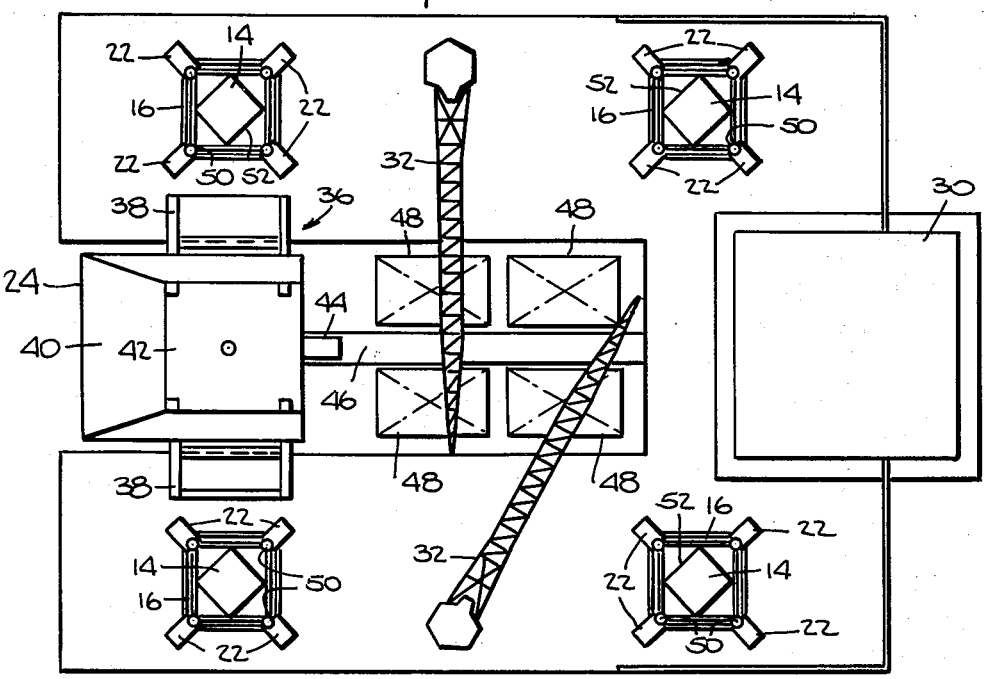
FIG. 3 is a plan view of the rig of FIG. 1.

The drilling and production rig shown in FIGS. 1-3 comprises a hull 10, formed as a platform, which is supported a predetermined distance above a sea surface 12 by means of four girder-like support legs 14. The legs 14 pass through support leg wells 16 (FIG. 3) in the hull 10 and they extend down to the sea bed 18. Foot pads 20 are provided on the bottom of the legs 14 to distribute the weight of the rig. Depending upon the nature of the sea bed 18 the foot pads will penetrate a greater or less distance into it before they meet the necessary resistance to support the weight of the legs 11, the hull 10 and the various equipment carried on the hull.

The platform hull 10 is of barge-like construction and is flotatable with the legs 14 and foot pads 20 raised up off the sea bed 18. Jacking mechanisms 22 are provided on the hull 10 to move the legs 14 up and down when the hull 10 is floating and to lift the hull up on the legs or lower it when the foot pads 20 are resting on the sea bed 18.

It will be appreciated from the foregoing that the entire assembly may be floated, with the legs elevated, and towed out to a desired offshore location; and then, by operating the jacking mechanisms 22, the legs 14 may be lowered to the sea bed 18 and the hull 10 may be jacked up on the legs 14 to an elevated position, as shown, away from the effects of wave and current action. As a result there is provided a very stable platform for carrying out bottom drilling and production operations for extraction of oil or other materials from under the sea bed.

The jacking mechanisms 22 may be any of several well known types, for example they may comprise slip type hydraulically activated mechanisms such as shown in U.S. Pat. No. 2,352,370 or they may comprise rack and pinion mechanisms as shown in U.S. Pat. No. 2,308,743. The general idea of a floating platform which carries legs and jacking mechanisms for lifting the platform up out of the water is not new. Arrangements for this purpose are shown in U.S. Pat. Nos. 2,308,743, 2,589,146 and 3,183,676 among others. The present invention involves specific improvements to this general arrangement as will be described hereinafter.

The platform hull 10 is of framework construction with sheeting forming a boxlike structure. The hull 10 is also internally bulkheaded to divide its interior into a number of isolated fluid tight storage tank compartments A–X (see FIG. 4). The compartments A–N extend vertically the full height or thickness of the hull, e.g. about twenty-four feet (7 meters) while the remaining compartments O–X extend upwardly from the bottom only about half the total hull thickness, e.g. about twelve feet (3.5 meters). Various items of fluid processing and production equipment (not shown), such as separators, pumps, manifolds, precipitators, instruments, etc. are provided on top of these last mentioned compartments.

Figure 4:
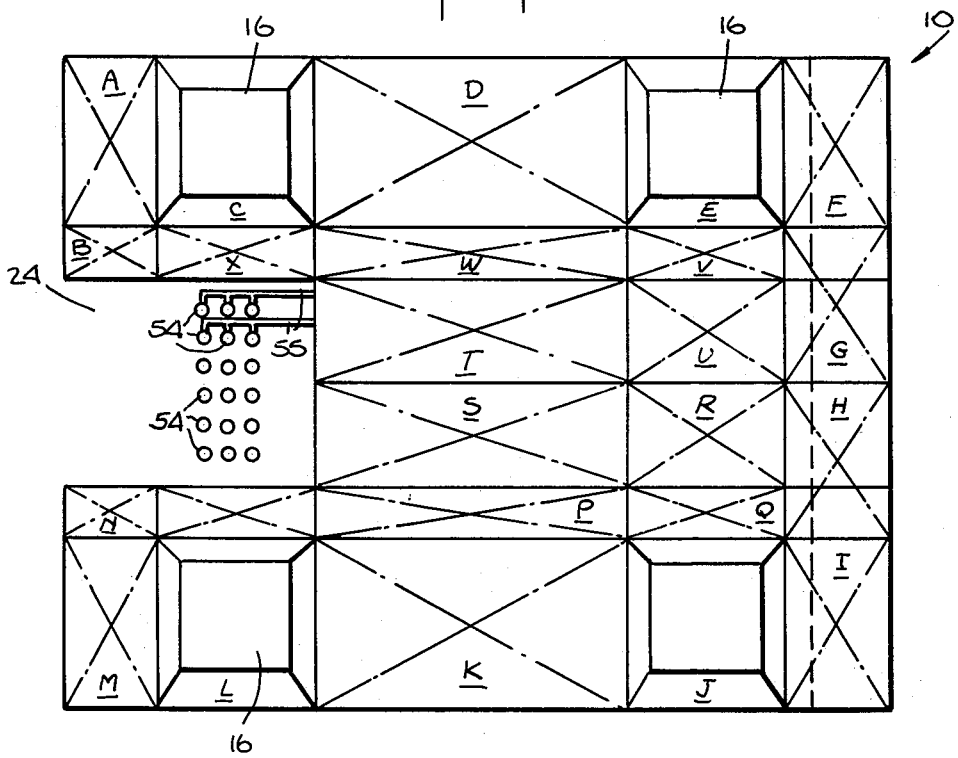
FIG. 4 is a section view taken along line 4—4 of FIG. 1.

It will be seen from FIGS. 3 and 4 that the hull 10 is formed with a slot-like drilling and production well 24 which extends between two of the leg wells 16. This drilling and production well 24 is also located to be adjacent to the area above the compartments O–X so that fluids passing up through conductors in the well 24 can be directed into the fluid processing and production equipment. The fluid that is processed in this equipment is directed into selected ones of the fluid compartments A–X for storage or ballast. The stored fluid may thereafter be transferred to ships docked at or moored close to the rig or it may be pumped through transmission lines extending along the sea bed from the rig to an onshore facility.

The upper surface of the platform hull 10 is flat and it forms a main deck 26. A crew quarters 28 is provided at one end of the main deck opposite from the drilling and production well 24. A helicopter pad 30 is constructed atop the crew quarters.

A pair of construction cranes 32 are mounted on pedestals 34 extending up from each side of the main deck 26.

A drilling module 36 is also mounted on the main deck 26 to straddle the drilling and production well 24. The drilling module 36 comprises a base 38 on one end of which is mounted an enclosed drilling compartment 40 and a drilling tower 42. The drilling compartment and tower extend directly over the drilling and production well 24. A pipe ramp 44 extends up from the surface of the base 38 to the drilling compartment 40. This pipe ramp is aligned with the drilling compartment 40 and a dragway 46 extending along the base 38. Lengths of drill pipe and casing 48 are arranged in piles on either side of the dragway. The cranes 32 are used to lift these lengths of drill pipe and casing, as well as other equipment, up off supply ships moored or docked at the rig. The lengths of pipe and casing 48 are dragged up the ramp 44 and into the drilling tower 42 for the usual drilling and pipe installation operations.

After all drilling operations have been completed the entire drilling module 36 can be removed as a single unit from the hull 10 and transported to another rig for additional drilling operations. It will be appreciated that the arrangement of the hull and drilling module are such that the operation of the drilling equipment on top of the hull does not interfere with the operation of the processing production and storage equipment contained within the hull. Thus it is possible with this arrangement to carry out drilling of several wells and to begin production from the first well as soon as it is completed without waiting until all of the wells have been drilled.

As indicated above, the legs 14 of the rig are of open framework construction. These legs are of square cross section (FIG. 3) and they each comprise corner struts 50 of relatively large diameter heavy wall tubing which is interconnected by spars 52 of relatively small diameter heavy wall tubing. The jacking mechanisms 22 are arranged to engage the legs 14 at the corner struts 50.

Reverting now to FIG. 2 it will be seen that a plurality of tubular conductors 54 extend from the drilling and production well 24 of the hull 10 down to and into the sea bed 18. These conductors serve to guide and support the drill pipe and casing both during drilling operations and during subsequent production operations.

The conductors 54 must extend for distances which may be as much as several hundred feet and they are subject to waves and currents which tend to bend them. In order to brace these conductors there are provided a number of conductor supports 56 which extend between two of the legs 14 in alignment with the drilling and production well 24 at different levels between the hull 10 and the sea bed 18. As shown in FIG. 4, some of the conductors 54 are connected, via conduits 55, to the interior of the hull and in this manner they are placed in fluid communication with the storage tanks and other production equipment therein. It will be appreciated that when a well has been drilled and oil flows up through its conductor 54, it will be directed via the conduits 55 to the production and storage equipment. Meanwhile the drilling tower may be used to drill another well through a different one of the conductors 54. Thus drilling and production operations may be carried on simultaneously without one interfering with the other.

Figure 5:
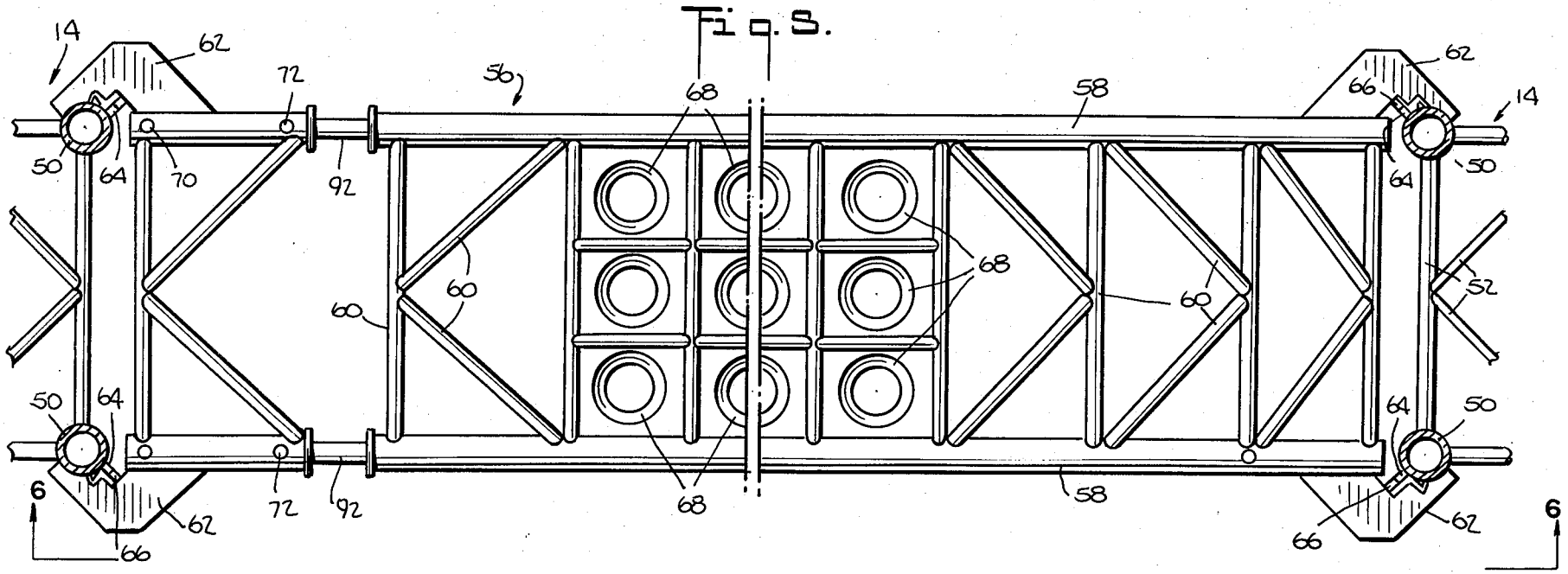
FIG. 5 is an enlarged view, partially broken away, taken along line 5—5 of FIG. 2 and showing a conductor support forming part of the drilling and production rig.
Figure 6:
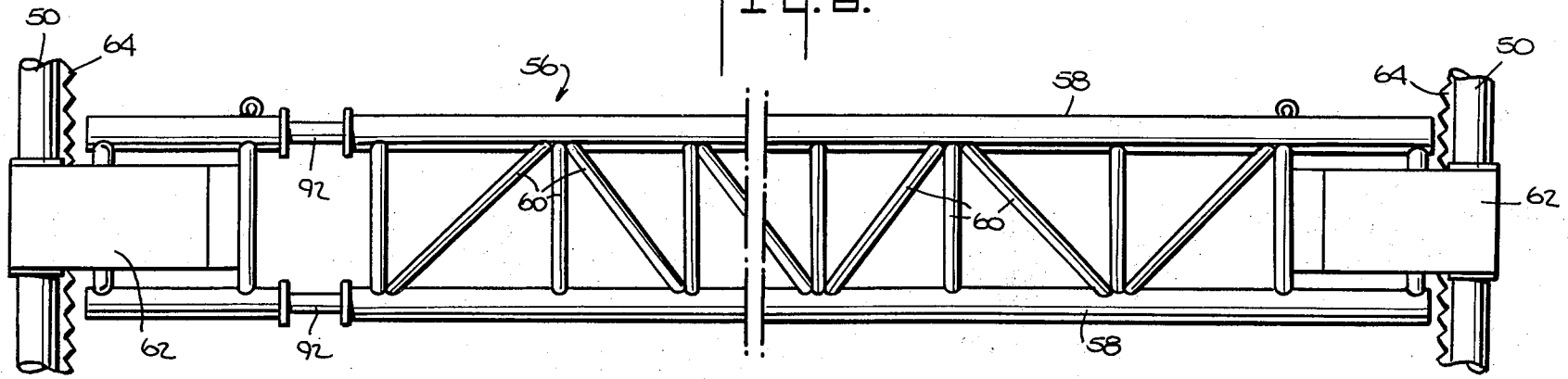
FIG. 6 is a view taken along line 6—6 of FIG. 5.

As can be seen in FIGS. 2, 5 and 6, the conductor supports 56 are also of open framework construction; and they comprise main outer tubular struts 58 interconnected by smaller diameter tubular spars 60. At each end of each conductor support 56 there are provided a pair of guides 62 which engage corresponding corner struts 50 of the associated leg 14. Racks 64 (FIG. 6) are mounted to extend along these corresponding corner struts 50 and these racks are engaged by pinions 66 (FIG. 5) on the conductor supports 56. Details of these pinions and their use in positioning the conductor supports 56 will be described in greater detail hereinafter.

Figure 7:
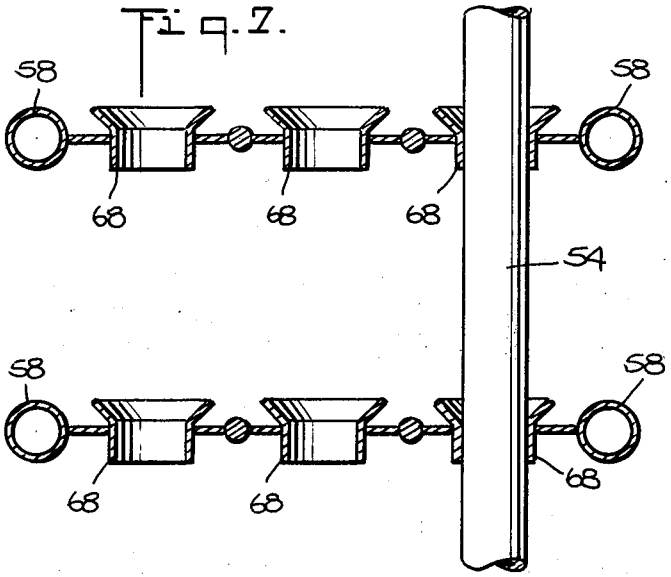
FIG. 7 is an enlarged fragmentary section view taken along line 7—7 of FIG. 2.
Figure 17:
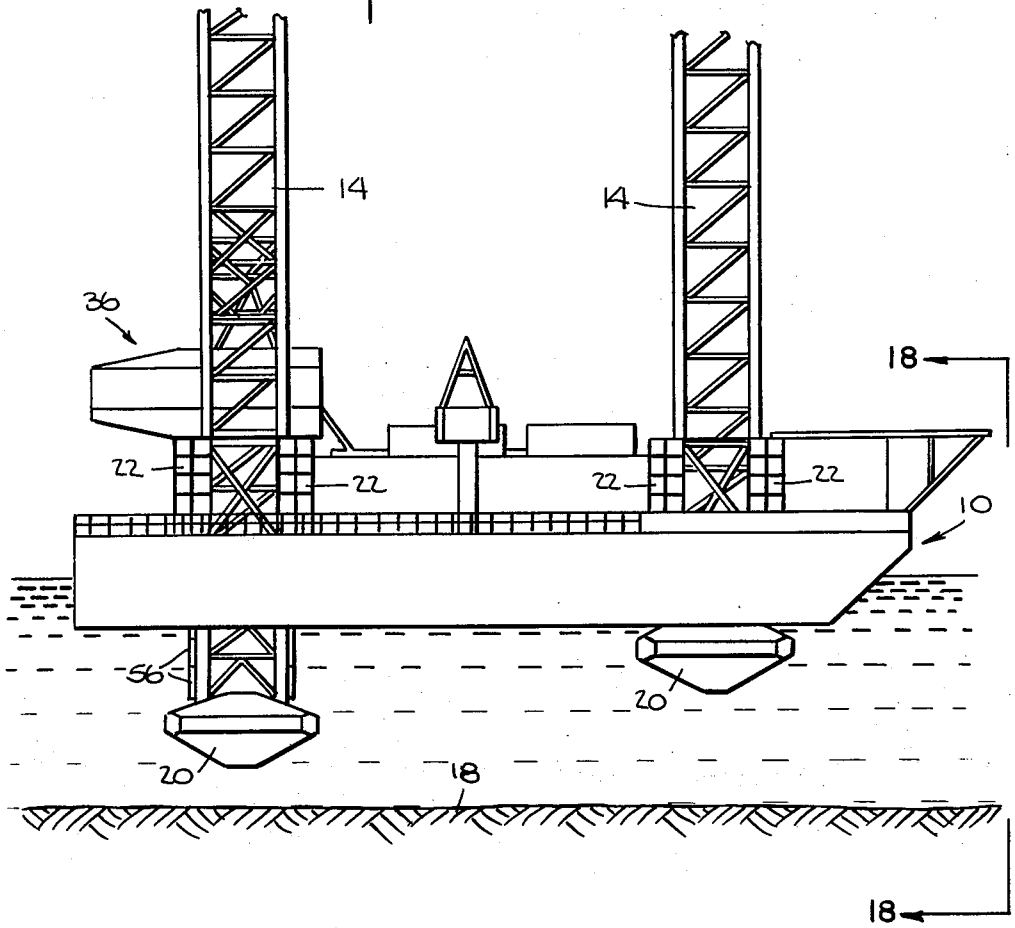
FIG. 17 is a view similar to FIG. 13 but showing the rig with conductor supports installed and legs elevated for floating of the rig to a desired location.

As shown in FIG. 5 the central region of the conductor support 56 is formed into a grid-like arrangement and funnel-like guides 68 are mounted in each of the grid openings. These guides, as shown in FIG. 7, accommodate and closely receive the conductors 54 and hold the conductors against lateral movement.

Figures 8, 9, 10:
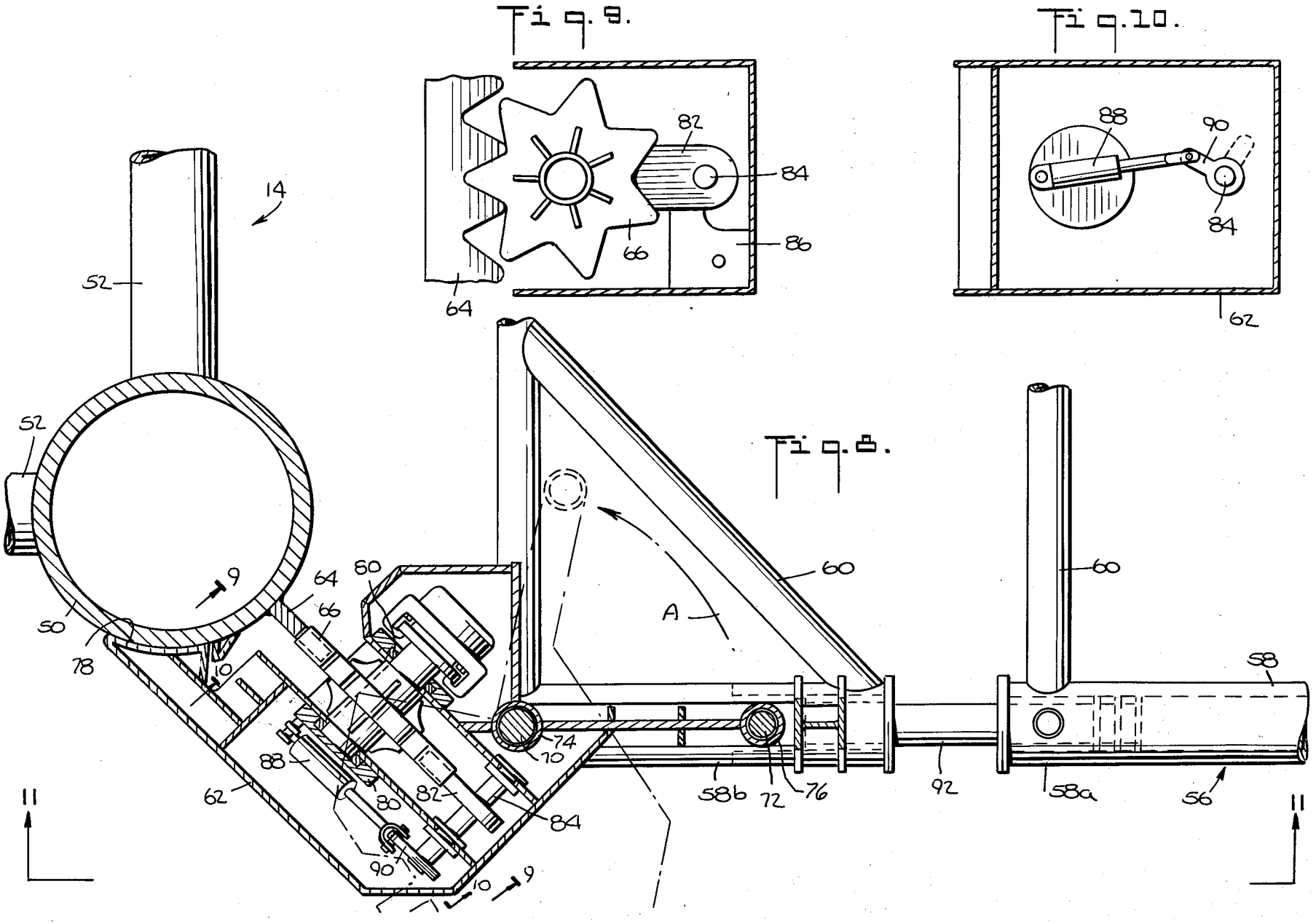
FIG. 8 is an enlarged fragmentary view, partly in section, showing in detail an end region of the conductor support of FIG. 5.
FIG. 9 is a fragmentary section view taken along line 9—9 of FIG. 8 and showing a lock mechanism used to lock the conductor to a leg of the rig.
FIG. 10 is a fragmentary section view taken along line 10—10 of FIG. 8 and showing an actuator used for the lock mechanism of FIG. 9.
Figure 11:
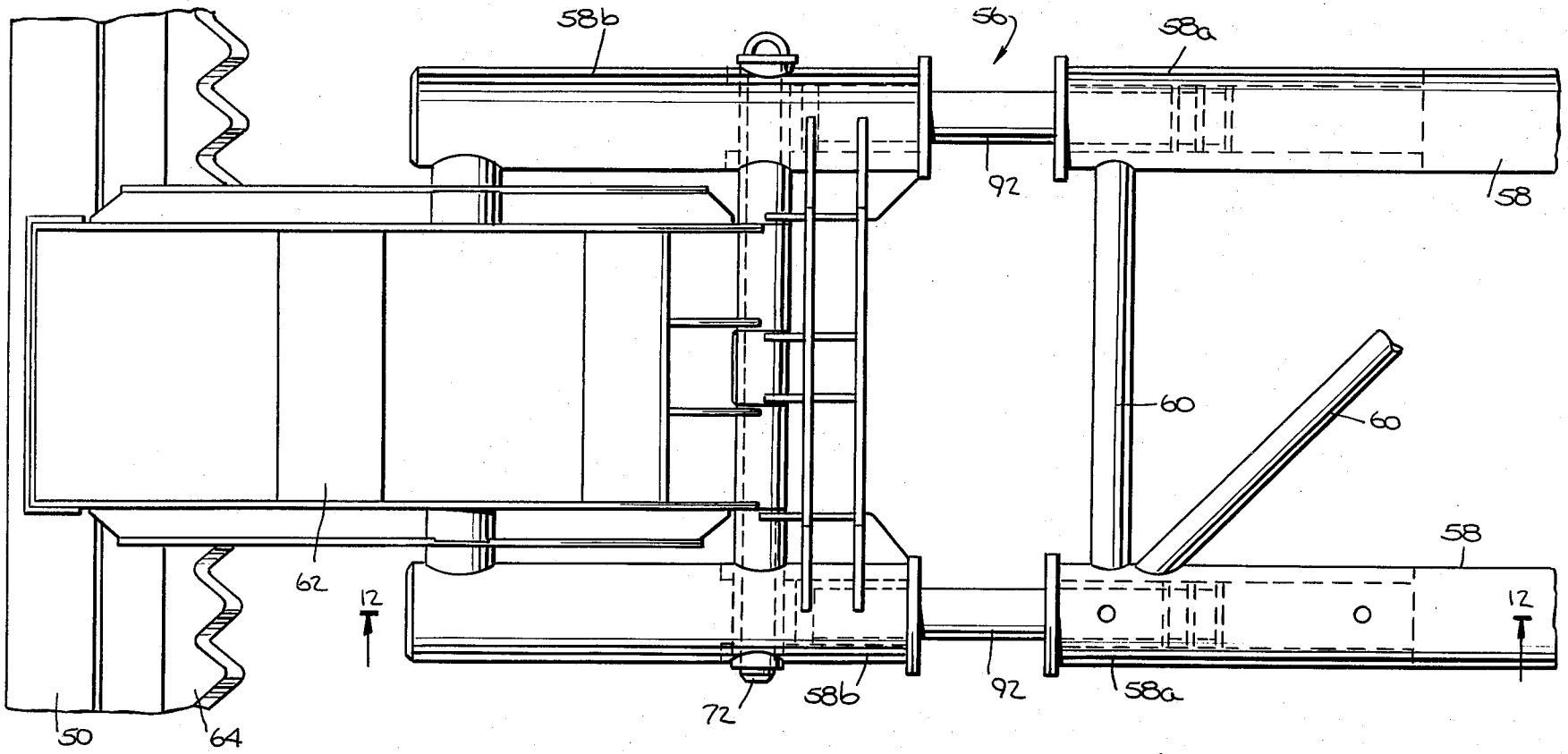
FIG. 11 is a view taken along line 11—11 of FIG. 8.

FIGS. 8–12 illustrate in detail the interconnections between the ends of the conductor supports 56 and the legs 14. As shown in FIGS. 8 and 11 the guide 62 is mounted between upper and lower outer struts 58 of the conductor support 56 to extend out beyond the end thereof. Vertical pins 70 and 72 in the conductor support pass through tubular bushings 74 and 76 in the guide 62. The guide 62 itself is of box-like construction and is formed with an outer concave abutment wall 78 which rests against the corner strut 50 of the leg 14. The pinion 66 (FIG. 9) is mounted to turn in bearings 80 which in turn are supported in the guide 62. The guide is so constructed that when its abutment wall 78 rests against the corner strut 50 the pinion 66 will be properly meshed in the rack 64.

As mentioned above, there are provided two guides 62 with associated pinions 66 at each end of each of the conductor supports 56. One of these two guides 62 is fixed in the position shown in FIG. 8; however the other is swingable about the forwardmost vertical pin 70 when the rearward pin 72 is removed. This allows the guide 62 to swing in the direction of the arrow A in FIG. 8 to provide clearance for the conductor support to be positioned between the legs 14.

The pinions 66 can be locked from rotation in their respective bearings 80 to prevent relative movement between the conductor support 56 and the leg 14. This locking ability is provided by means of a jam bar 82 mounted to swing about an axle 84 in the guide 62 into engagement with the teeth of the pinion 66 as shown in FIG. 9. A stop element 86 limits the rotation of the jam bar 82 and thereby prevents rotation of the pinion. A solenoid 88, which may be either hydraulically or electrically energized, is also mounted on the guide 62; and, as shown in FIGS. 8 and 10, this solenoid is connected via a crank arm 90 to the axle 84. By controlling the energization of the solenoid 88 the position of the jam bar 82 can be controlled with respect to the pinion 66 to lock it or unlock it as may be desired.

As will be described more fully hereinafter, the conductor supports 56 move up and down along the legs 14 during positioning and removal of the rig at a particular offshore location. During this movement it is important that the pinions 66 remain engaged in the racks 64. However, because of the nature of the connection between the legs 14 and the hull 10 and because of the depths to which the legs must extend and the lateral forces to which they are subjected, the legs cannot be counted on to remain perfectly parallel and equally spaced along their length.

Figure 12:
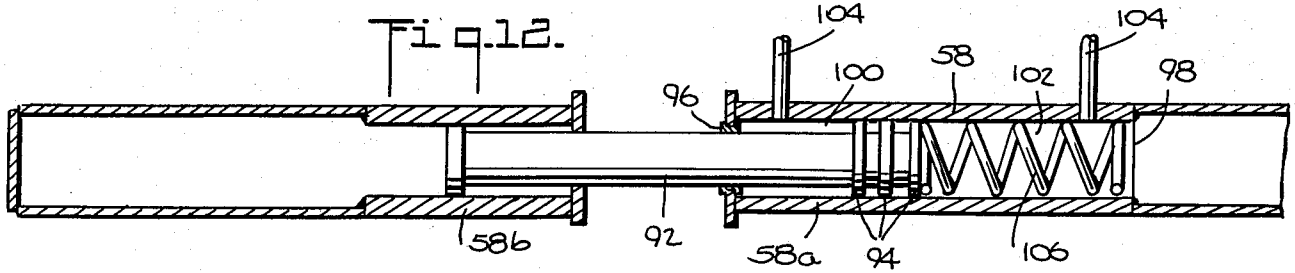
FIG. 12 is a fragmentary section view taken along line 12—12 of FIG. 11.

The conductor supports 56 are constructed to ensure that the pinions 66 remain in engagement at all times with the racks 64 on the legs 14 even when the legs are not perfectly parallel. This feature is achieved, as shown in FIGS. 8, 11 and 12, by means of a telescoping construction at one end of each of the outer tubular struts 58. This telescoping construction comprises a piston-like inner rod 92 mounted to slide into and out from one of two relatively axially moveable segments 58*a* and 58*b* of each outer tubular strut 58. The rod 92 is fixed with respect to the other segment. The rod 92 is provided with piston-like rings 94 inside the one segment and the end of that segment is provided with a sliding seal 96 around the rod. A wall 98 is formed within the segment thereby forming two hyraulic chambers 100 and 102 on opposite sides of the rings 94. Hydraulic lines 104 are connected between these chambers and a remote hydraulic control system (not shown). A spring 106 is inserted between the wall 98 and the rod 92 to exert an axial force on the rod 92 for urging the segments 58*a* and 58*b* apart. The force of the spring 106 may be overcome and the segments 58*a* and 58*b* may be retracted for initial positioning of the conductor support between the legs 14 by controlling the flow of hydraulic fluid through the lines 104 into and out from the hydraulic chambers 100 and 102.

Figure 13:
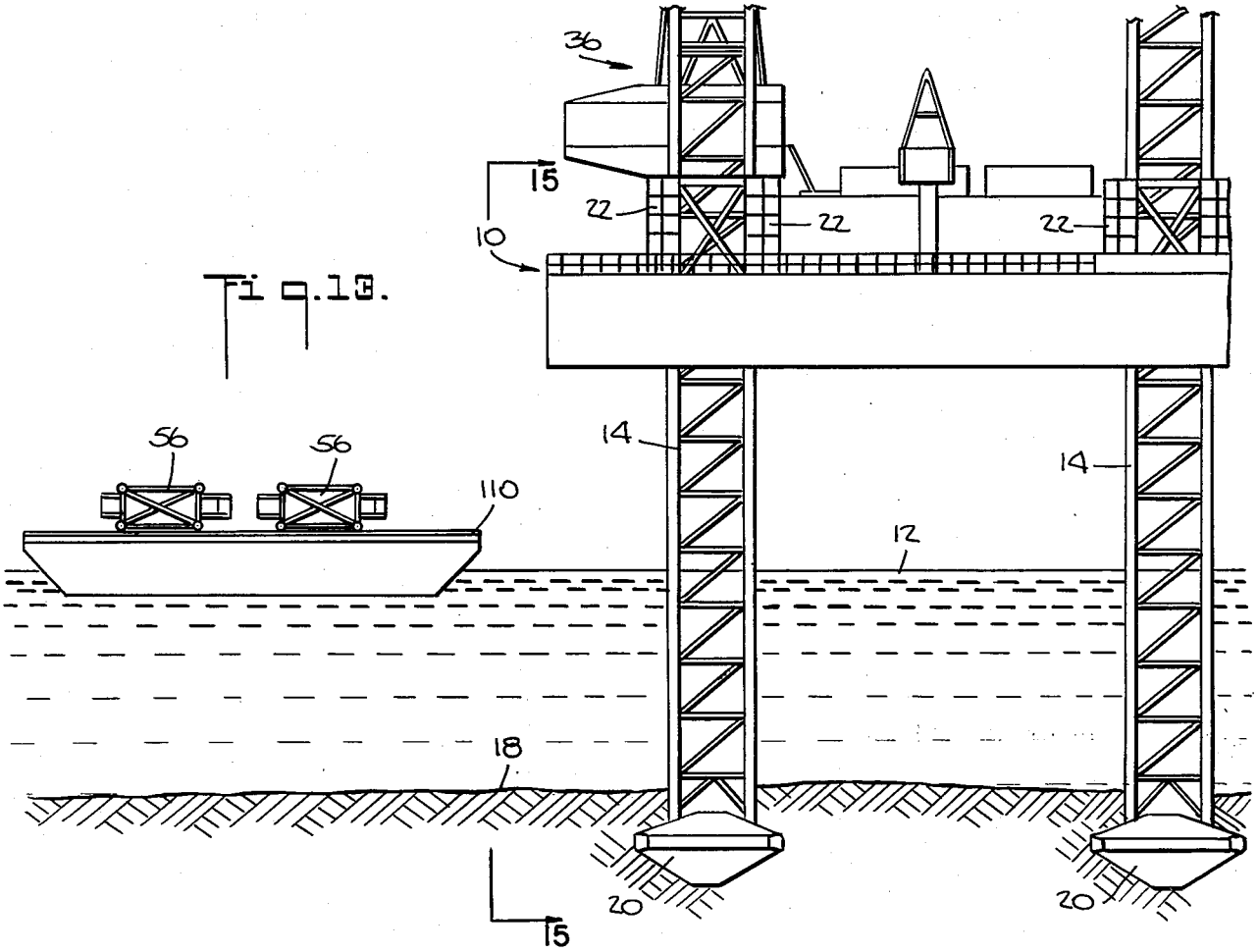
FIG. 13 is a side elevational view of the rig of FIG. 1 elevated above shallow water to receive conductor supports and a barge carrying said conductor supports to the rig.
Figure 14:
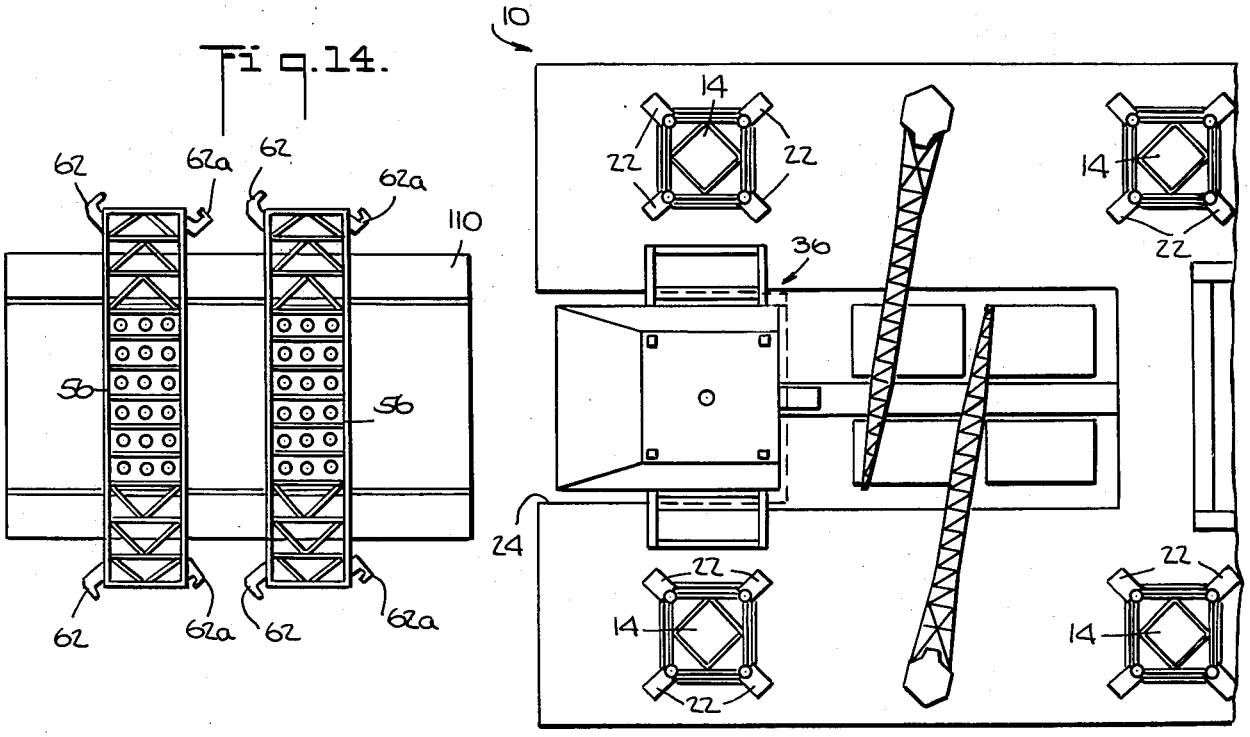
FIG. 14 is a plan view of the rig and barge of FIG. 13.

FIGS. 13–17 illustrate the manner of installing the conductor supports 56 on the rig. This installation, as shown in FIG. 13, takes place at a shallow water location, preferably near the site where the rig is built or reconditioned. The rig, as shown, is completely outfitted with the drilling module 36 in place. The legs 14 are first lowered to the sea bed 18 and the hull 10 is raised above the water. A tender barge 110 carrying the conductor supports 56 thereon is floated toward the rig. As shown in FIGS. 14 and 15 the barge 110 fits between the legs 14 and the conductor supports 56 extend out over the sides of the barge. The forwardmost of the guides 62 at each end of the conductor supports is pivoted to an open position (as illustrated at 62*a*) to allow the conductor support to fit between the legs.

Lifting lines 112 (FIG. 15) extend down from winches 114 on the drilling module 36 and are secured to the forwardmost of the conductor supports 56 when it becomes positioned between the legs 14 as shown in phantom outline in FIG. 16. At this point the open guides 62*a* are swung closed and the pins 72 (FIG. 8) are put in place so that the conductor guides 56 are securely engaged with the legs 17 and their pinions 66 are meshed with the racks 64. The solenoid 88 is controlled to bring the stop element 86 out of engagement with the pinion 66 so that the pinion can rotate and ride along the rack 64. The winches 114 are then operated, as shown in FIG. 15, to lift the conductor support up off the barge 110 and to bring it up into position under the hull 10.

When the conductor support 56 is so positioned, its solenoid 88 may be controlled to bring the stop element 86 into locking engagement with the pinion 66 so that the conductor support becomes locked in place on the legs 14. The lifting lines 112 may then be disconnected and lowered back down to the barge 110. Meanwhile the barge has moved forward to bring a second conductor support 56 into position between the legs 14. The open guides on the second conductor support are then closed and the lifting lines 112 are attached and used to raise the second conductor support in the same manner. Additional conductor supports may be provided as needed, depending upon the depths and lateral forces to be encountered; and these additional supports may be installed in the same manner.

After the conductor supports 56 have been installed as above described they are clamped to the underside of the hull 10 by any suitable means (not shown) and the various solenoids 88 are controlled to remove each jam bar 82 from its associated pinion 66. This disengages the conductor supports from the legs 14 and allows the hull 10 with the conductor supports to be lowered down until it floats in the water. The legs 14 are then lifted up off the sea bed; and the rig in the condition illustrated in FIG. 17 may then be floated to a desired offshore location.

Figure 18:
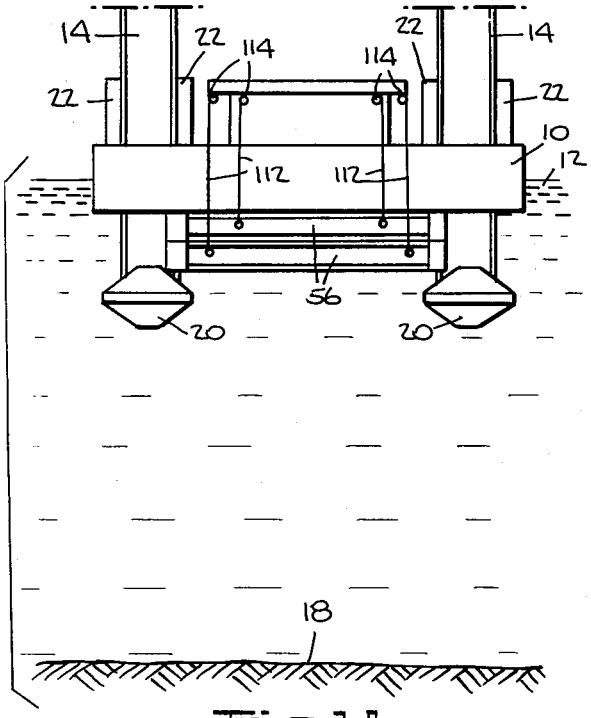
FIG. 18 is a view taken along line 18—18 of FIG. 17.

FIGS. 18–21 illustrate in sequence the steps of installing the rig at an offshore location. For purposes of simplicity the drilling module 36 is not shown in FIGS. 18–21, although in most instances it would be carried out on the rig to begin conductor installation and drilling operations as soon as the hull is elevated at a desired offshore location. As shown in FIG. 18 the legs 14 of the rig are lifted and the hull 10 is afloat. At the same time the conductor supports 56 are held up against the underside of the hull 10. The rig in this condition is floated to a desired offshore location.

Figure 19:
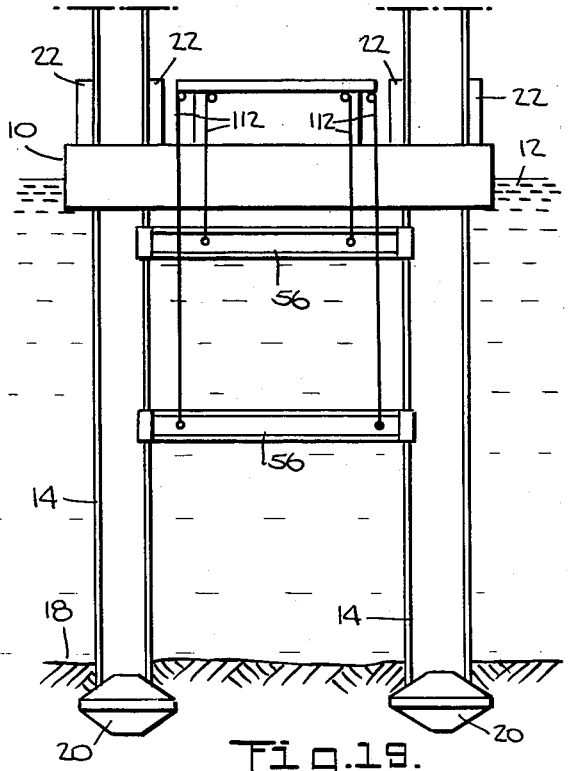
FIG. 19 is a view similar to FIG. 18 but showing the legs of the rig positioned on the sea bed.

When the rig reaches a desired location the legs 14 are lowered in the usual manner as shown in FIG. 19. During the initial phase of this leg lowering operation the conductor supports 56 are held up against the underside of the hull and the jam bars 82 (FIG. 9) are raised out of engagement with the pinions 66 so that these pinions can turn as the rack 64 of each leg 14 moves downwardly.

When the legs 14 have been lowered to a predetermined amount, the jam bars 82 are reengaged to lock the pinions 66 of the lower conductor support 56 and the conductor support is released from the underside of the hull 10. The legs 14 are then lowered still further; and, because the lower conductor support 56 is now locked to them they carry it down with them. It will be appreciated that because of the telescoping arrangement at the end of the conductor support 56 (FIG. 8) the conductor support will automatically accommodate itself to any variations in spacing between the legs 14 as they are lowered.

The upper conductor support can be locked to the legs, released from the hull and lowered in the same manner. By selecting the amount by which the legs 14 are lowered when the various conductor supports are locked to them and released from the hull the installed height of the conductor supports can easily be controlled. This provides considerable flexibility in that the rig is readily adaptable to provide optimum conductor support at different conditions of water depth and flow. It will be appreciated from the foregoing that while the conductor supports 56 are placed at different depths, it is not necessary, with the arrangement of the present invention, to use divers or to undertake any substantial underwater work in installing the conductor supports. Instead all installation work, which involves merely releasing the conductor supports from the hull and locking them to the legs, can be done at the hull itself. This is very advantageous from a standpoint of economy, speed and safety in the installation operations.

Figure 20:
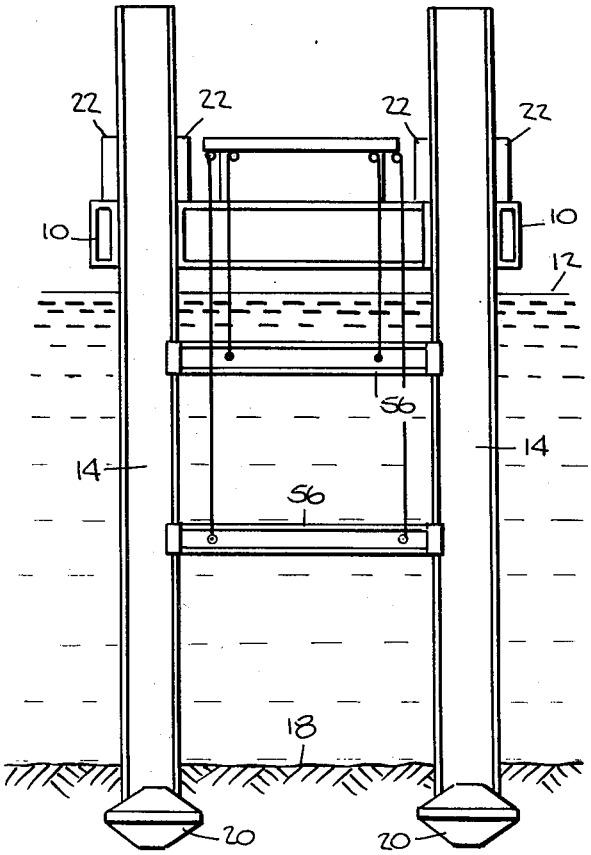
FIG. 20 is a view similar to FIG. 19 but showing the platform portion of the rig slightly elevated above the sea surface for initial ballast testing.
Figure 21:
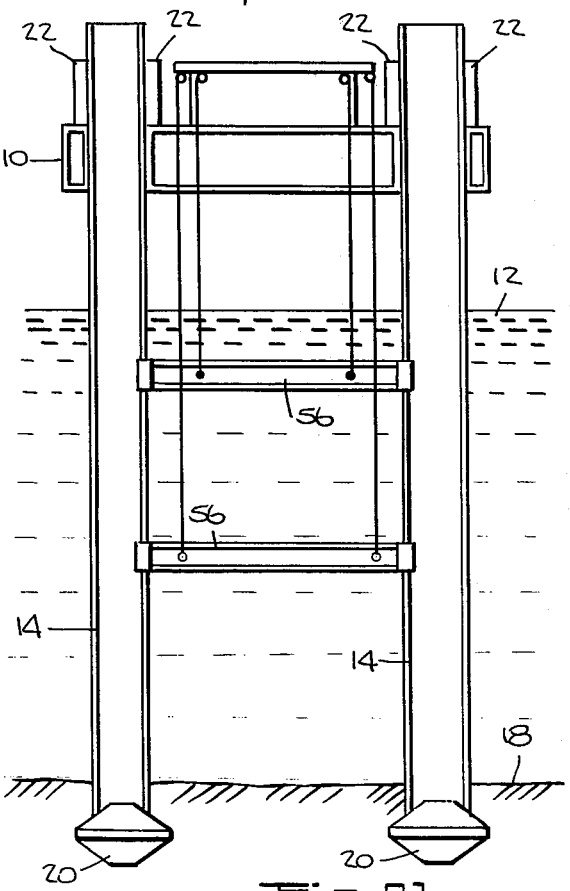
FIG. 21 is a view similar to FIG. 20 showing the platform fully raised to operating position.

After the legs 14 have reached the sea bottom the hull 10 is jacked up slightly above the sea surface as shown in FIG. 20. At this point some or all of the storage tank compartments A–X in the hull 10 are filled with sea water to ballast the rig and to test the bearing capacity of the leg feet 20. The storage tank compartments are then pumped out and the hull 10 may then be raised to its full height as shown in FIG. 21.

When the hull 10 has been raised the conductors 54 are installed through the conductor supports 56 and exploratory drilling is commenced. Should the initial drilling operations show that the region is not likely to be productive, the hull may be lowered and the legs raised so that the rig may be floated to a new location. If, however, the exploratory drilling indicates that the region will be productive, the rig may remain in place; and as soon as each well is drilled through a different conductor 54, conduit may be installed in the conductor and connections may be made to the production and storage equipment inside the hull 10. Thus production may be obtained from the first drilled well while other wells are being drilled.

After drilling is complete, the drilling module 36 may be removed for use elsewhere while the rig remains for production until the wells have been depleted.

Figure 22:
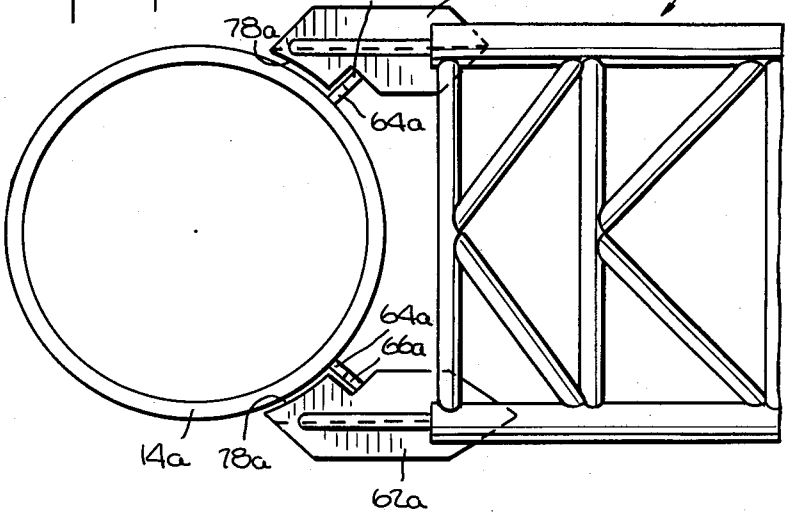
FIG. 22 is a fragmentary section view of one end of a conductor support engaging a cylindrical leg according to a modification of the invention.

For some applications it may be preferred to employ cylindrical legs for the rig in contrast to the open framework legs 14. FIG. 22 shows such an arrangement with one end of a conductor support 56 in engagement with a cylindrical leg 14*a*. The leg 14*a* is provided with spaced apart vertically extending racks 64*a* and these racks are engaged by pinions 66*a* on guides 62*a* extending from the end of the conductor support. The guides 62*a* have curved abutment walls 78*a* which rest against the surface of the leg 14*a* adjacent the racks 64*a*. At least one of the guides 62*a* is pivotally connected to the conductor support and may be opened and closed in the same manner as the guide 62 in FIG. 8 so that it can be fitted to the leg. Also, the pinions 66*a* may be locked and unlocked in the same manner as the pinions 66 of FIG. 8.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. An offshore platform structure comprising a barge-like flotatable hull, a plurality of support legs mounted on said hull to move up and down with respect to said hull, jacking mechanisms interconnecting said hull and said legs to lift said legs up from the sea bottom for floating said hull to a desired offshore location, to lower said legs down to the sea bottom at said desired offshore location and to lift the hull up above the sea surface onto the thus lowered legs, said hull being formed with an opening located between two of said legs for accommodating elongated conductors extending down from a drilling tower mounted on said hull over said opening, at least one conductor support extending between said two legs under said hull, said conductor support being formed with guide sleeves in alignment with said opening to guide and give lateral support to said conductors, said conductor support including leg engaging means at each end thereof for holding said conductor support to said two legs, said leg engaging means being formed and constructed to allow said conductor support to move up and down freely along said two legs while being guided thereby, releaseable means for holding the conductor support to the underside of the hull, and selectively lockable means for locking said conductor support against up and down movement on said legs.

2. An offshore platform structure according to claim 1 wherein said leg engaging means include a portion which is moveable between an open position for allowing said conductor support to be positioned between said two legs and a closed position locking said conductor support against lateral movement with respect to said two legs while permitting free up and down movement between said conductor support and said legs.

3. An offshore platform structure comprising a barge-like flotatable hull, a plurality of support legs mounted on said hull to move up and down with respect to said hull, jacking mechanisms interconnecting said hull and said legs to lift said legs up from the sea bottom for floating said hull to a desired offshore location, to lower said legs down to the sea bottom at said desired offshore location and to lift the hull up above the sea surface onto the thus lowered legs, said hull being formed with an opening located between two of said legs for accommodating elongated conductors extending down from a drilling tower mounted on said hull over said opening, at least one conductor support extending between said two legs under said hull, said conductor support being formed with guide sleeves in alignment with said opening to guide and give lateral support to said conductors, said conductor support including leg engaging means at each end thereof for holding said conductor support to said two legs, said leg engaging means being formed and constructed to allow said conductor support to move up and down freely along said two legs while being guided thereby, said leg engaging means including selectively lockable brake means for locking said conductor support against up and down movement with respect to said legs, said two legs each being provided with a gear rack extending longitudinally thereof, said conductor support being provided with pinion gears mounted and positioned to mesh with and roll along said gear racks when said conductor support moves up and down with respect to said legs and said brake means being arranged to control rotation of said pinion gears.

4. An offshore platform structure according to claim 3 wherein said conductor support includes at least one moveable end portion on which one of said pinion gears is mounted and a leg surface abutment fixed with respect to said one pinion gear on said moveable portion whereby when said leg surface abutment engages the surface of said leg the pinion gear is held in proper position with respect to said rack.

5. An offshore platform structure according to claim 3 wherein said lockable brake means comprises a pivotal jam bar mounted to be wedged between the teeth of at least one of said pinion gears.

6. An offshore platform structure according to claim 4 wherein said moveable end portion comprises an arm having a leg engaging surface thereon, said arm extending out from the end of said conductor support and pivotally mounted thereon for movement between said closed and opened positions and locking means for holding said arm against pivotal movement away from said closed position.

7. An offshore platform structure according to claim 1 wherein said conductor support is longitudinally extensible to permit said leg engaging means to remain engaged with said two legs during relative up and down movement of said conductor support with respect to said two legs despite variations in the spacing between said two legs at different elevations.

8. An offshore platform structure according to claim 7 wherein said conductor support is formed at one end with telescoping members between the leg engaging means at the opposite ends of said conductor support and extensible longitudinally of said conductor support.

9. An offshore platform structure according to claim 8 wherein said telescoping members are resiliently biased to their extended position.

10. An offshore platform structure according to claim 9 when said telescoping members are formed as a piston and cylinder and are hydraulically biased toward their extended position.

11. An offshore drilling and production rig comprising a flotatable platform hull, a plurality of upright support legs mounted on said platform to move vertically with respect to same, jacking means interconnected between said platform and said legs to move said legs up and down so that said platform can float to a desired location carrying said legs up off the sea bottom and, upon arrival at said location, said legs can be lowered to the sea bottom and the platform can be jacked up on said legs to a position above the surface of the sea, at least one conductor support extending in a generally horizontal direction between two of said legs and having conductor openings through which tubular conductors for containing drlling strings and production tubing can extend and said platform being formed with a drilling and production well between said two legs in alignment with said conductor openings, said platform hull containing oil production equipment including storage tanks in fluid communication with at least some of said conductors.

12. An offshore drilling and production rig according to claim 11 wherein a drilling module is mounted on top of said platform hull over said drilling and production well in alignment with said conductor openings.

13. An offshore drilling and production rig according to claim 12 wherein said drilling module is removeable from said platform hull.

14. A method of erecting a jack-up type offshore drilling and production rig comprising a flotatable platform hull, jackable support legs and conductor supports extending between two of said legs, said method comprising the steps of floating said rig to a desired offshore location with its legs elevated and with at least one conductor support extending between the legs and held against the underside of the hull, then lowering the legs a predetermined distance while holding the conductor support to the underside of the hull, thereafter locking said conductor support to said legs and releasing said conductor support from said hull, and then continuing to lower said legs, and after said legs have reached the sea bed, jacking said hull up on said legs and out of the water.

15. A method according to claim 14 wherein said rig is provided with a plurality of conductor supports arranged one above the other between said legs and held to the underside of said hull, and wherein said conductor supports are successively locked to said legs and released from said hull at different lowered positions of said legs.

* * * * *